US007982383B2

(12) United States Patent
Corazza et al.

(10) Patent No.: US 7,982,383 B2
(45) Date of Patent: Jul. 19, 2011

(54) MERCURY DISPENSING DEVICES WITH A REDUCED PARTICLE LOSS

(75) Inventors: Alessio Corazza, Como-Camnago Volta (IT); Vincenzo Massaro, Albairate (IT); Diego Di Giampietro, Palombaia di Sassa (IT); Gianni Santella, Tornimparte (IT)

(73) Assignee: Saes Getters S.p.A., Lainate (IT)

( * ) Notice: Subject to any disclaimer, the term of this patent is extended or adjusted under 35 U.S.C. 154(b) by 0 days.

(21) Appl. No.: 12/746,481

(22) PCT Filed: Dec. 12, 2008

(86) PCT No.: PCT/EP2008/067454

§ 371 (c)(1),
(2), (4) Date: Jun. 4, 2010

(87) PCT Pub. No.: WO2009/080569

PCT Pub. Date: Jul. 2, 2009

(65) Prior Publication Data

US 2010/0259167 A1 Oct. 14, 2010

(30) Foreign Application Priority Data

Dec. 21, 2007 (IT) ..... MI2007A2424

(51) Int. Cl.
*H01J 1/62* (2006.01)

(52) U.S. Cl. ..... 313/490; 313/565

(58) Field of Classification Search ..... 313/490, 313/546, 564, 565, 574
See application file for complete search history.

(56) References Cited

U.S. PATENT DOCUMENTS

| | | | | |
|---|---|---|---|---|
| 3,657,589 | A | 4/1972 | Della Porta et al. | |
| 4,870,323 | A * | 9/1989 | Parks et al. | 313/546 |
| 6,679,745 | B2 | 1/2004 | Santella et al. | |
| 7,674,428 | B2 * | 3/2010 | Coda et al. | 420/587 |

FOREIGN PATENT DOCUMENTS

| | | |
|---|---|---|
| EP | 0 737 995 | 10/1996 |
| WO | 98/53479 | 11/1998 |
| WO | 2006/008771 | 1/2006 |
| WO | 2006/030996 | 3/2006 |
| WO | 2006/075347 | 7/2006 |

OTHER PUBLICATIONS

PCT International Search Report for PCT/EP2008/067454 filed on Dec. 12, 2008 in the name of SAES GETTERS S.P.A.
PCT Written Opinion for PCT/EP2008/067454 filed on Dec. 12, 2008 in the name of SAES GETTERS S.P.A.

* cited by examiner

*Primary Examiner* — Vip Patel
(74) *Attorney, Agent, or Firm* — Steinfl & Bruno LLP

(57) ABSTRACT

Mercury dispensers (10; 20) having a highly reduced particle loss and containing a mixture of powders of a mercury releasing compound and of a plastic metal or alloy and optionally of a getter material are described. A mercury dispensing device (10:20) has a filiform cross-section, obtained by cutting a manufactured product having the same cross-section but a higher length, and comprises a metal container (11;21) and a mixture (12;22) of powders, comprised of at least one material suitable for releasing mercury by heating and a metal or a metal alloy, said mixture being arranged inside the container. Said metal or metal alloy has a Vickers hardness lower than 130 HV, its weight percentage is lower than the 10% of the total weight of the powders mixture and the size of the powders of said metal or alloy are not bigger than the size of the other powders of the mixture.

21 Claims, 3 Drawing Sheets

MERCURY DISPENSING DEVICES WITH A REDUCED PARTICLE LOSS

CROSS REFERENCE TO RELATED APPLICATIONS

The present application is the US national stage of International Application PCT/EP2008/067454 filed on Dec. 12, 2008 which, in turn, claims priority to Italian Application MI2007A002424, filed on Dec. 21, 2007.

The present invention relates to mercury dispensing devices having a highly reduced particle loss.

Mercury dispensers are particularly useful in the manufacturing of fluorescent lamps. As it is known, these lamps require for their operation a gaseous mixture comprised of noble gases at a pressure of from a few to some hundreds of hectoPascal (hPa) and the presence of mercury vapors.

The present manufacturing processes of lamps require the use of systems for adding mercury that ensure that the precision in dosing the element to be as high as possible. This requirement comes from the opposite needs of having a mercury amount not lower than given minimum values in order to allow the operation of the lamp and, at the same time, given the toxicity of mercury, of having an amount of mercury as small as possible in order to meet the international standards relating to the use of mercury. These requirements of extreme dosing precision are particularly difficult to meet in the case of the lamps used for the backlighting of liquid crystal displays (LCD): these lamps in fact, differently from those used for ambient illumination, have a diameter of few millimeters and consequently a very small volume, thus requiring an exact and reproducible dosing of mercury amounts of few milligrams.

International patent publication WO 98/53479 in the applicant's name discloses mercury dispensers comprised of a metal container that is not completely closed and containing a mixture of powders of a compound of titanium and mercury (preferably having the formula $Ti_3Hg$) and of a getter material, i.e. a metal (preferably zirconium) or an alloy (preferably zirconium with one or more other elements chosen among transition metals and aluminum). The getter material has the property of sorbing traces of gases such as water, oxygen, hydrogen and carbon oxides whose presence in the manufactured lamp would jeopardize its operation. By heating at temperatures of about 800-900° C., these dispensers release nearly the whole amount of mercury contained, thus allowing a precise control of the element introduced in the lamp. In particular from the industrial point of view, the most useful dispensers among those described in the above-mentioned publication are the dispensers obtained by cutting a filiform manufactured product having a trapezoidal cross-section about 1 mm wide and an indefinite length. Such a type of dispenser is manufactured through a process comprising the steps of: making a metal strip pass through suitable rolls wherein the strip is given a V-shaped cross-section having a flat bottom; filling the upper open channel thus obtained with the above-described powder mixture; folding back the upper edges of the strip onto the powder surface by leaving between these edges a slit of a width variable between about 200 and 400 micrometers (μm); pressing the powders in the manufactured product thus obtained with a roll having a width equal to the width of the slit; and finally cutting the filiform manufactured product at a desired length. A dispenser so manufactured has had a great commercial success in the last years due to the ability of precisely dosing mercury and also to its reduced lateral size, allowing to employ it into the LCD backlighting lamps during their manufacturing, in the so-called "double pinch-off" process described in the patent publication cited in the part of specification relating to FIG. 7.

Moreover this type of dispenser may be employed also in lamps designed to have these dispensers within the lamp itself, such configuration being described in the already cited international patent publication WO 98/53479.

A problem with these dispensers is that in some cases the cutting operation through which they are obtained starting from the initial filiform manufactured product may render unstable the package of compressed powders. This may result in a loss of some particles, in particular from the two surfaces of the powder package that are exposed after cutting. Therefore when the double-pinch off process is carried out the powders so produced may reach the zone where the glass tube is pressed and welded for the sealing of the manufactured lamp. If this happens the sealing is not perfect (in particular due to possible leaks present in the sealing area or to bubbles generated by the inclusion of particles in the molten glass) and the lamp has to be discarded. When a mercury dispenser is designed to be used within the lamp, the loss of particles may jeopardize its characteristics, for example causing the formation of dark spots.

It is therefore an object of the present invention to provide an improved mercury dispenser, which overcomes the drawbacks of the prior art, and in particular a dispenser that has all the advantages of the known filiform dispensers but has a reduced particle loss with respect thereto.

According to the present invention, these and other results are achieved with the use of a mercury dispenser having a filiform cross-section, obtained by cutting a manufactured product having the same cross-section but a higher length, comprising:

a metal container;

a mixture of powders comprised of at least one material suitable for releasing mercury by heating and a metal or a metal alloy arranged inside the container, characterized in that said metal or metal alloy has a Vickers hardness lower than 130 HV, the weight percentage of said metal or alloy is lower than the 10% of the total weight of the powders mixture and the size of the powders of said metal or alloy are not greater than the size of the other powders of the mixture.

The inventors have found that the addition of metals or metal alloys of the above-mentioned hardness to the powders mixtures used in similar known dispensers allows to reduce the particle loss that may occur from the edges resulting from the cutting through which the dispensers themselves are manufactured.

The invention will be described with reference to the following drawings, wherein.

Figure 1:
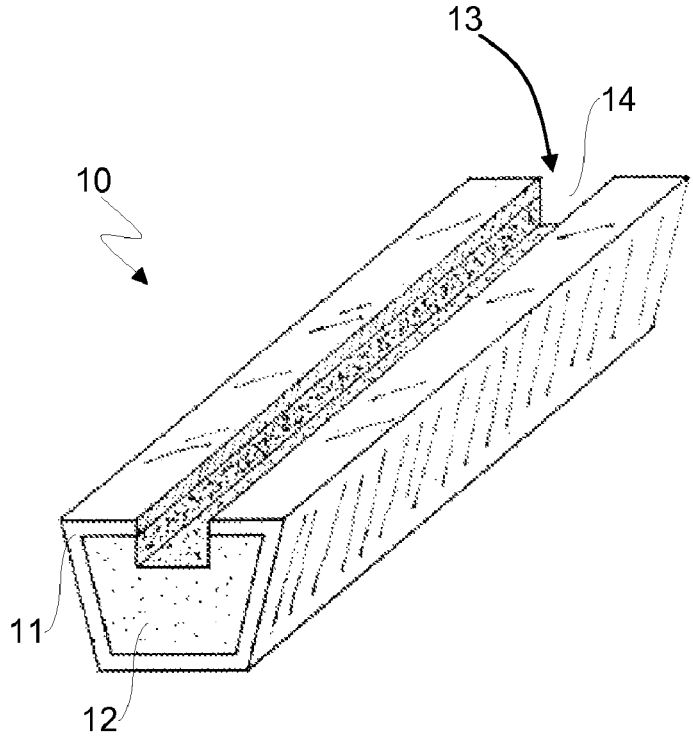
FIG. 1 shows a first embodiment of a dispenser of the invention.
Figure 2:
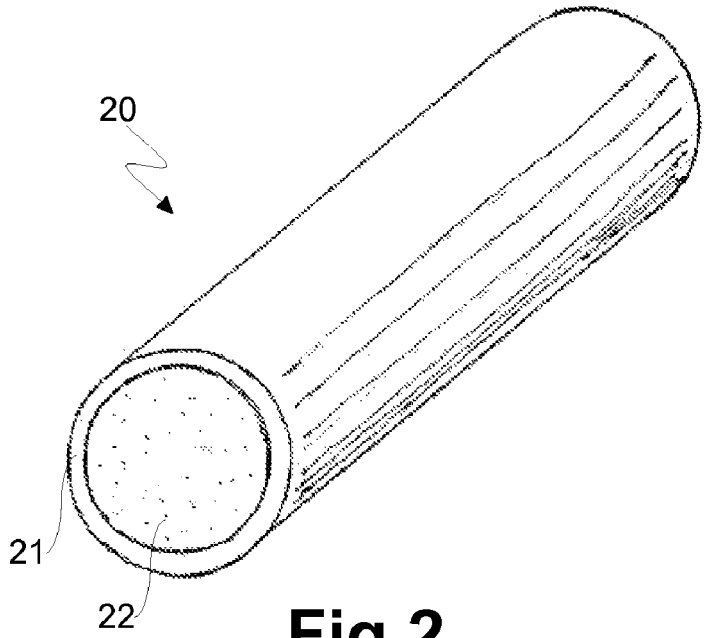
FIG. 2 shows a second possible embodiment of the dispenser according to the invention.

In FIGS. 1 and 2 the dimensions and dimensional ratio of the depicted elements, with particular and non-exclusive reference to the powders representation and their size, have been altered in order to improve the readability of these drawings.

The dispensers of the invention have an elongated shape, with a cross-section that may be generally inscribed in a circle having a diameter lower than 1.5 mm and a length of some millimeters. Since the filiform manufactured products from which the dispensers of the invention may be obtained by cutting have a constant linear load of mercury, the length of the dispensers depends on the amount of mercury that must be introduced into the lamp.

FIG. 1 shows a first embodiment of the dispenser of the invention. A dispenser 10 is formed of a metal container 11 manufactured by folding a metal strip around a mixture of powders 12 as previously described, in order to leave a slit 13 throughout the length of a face, also referable as side, of the dispenser. Typically, the width of the slit 13 is comprised between 200 and 400 μm. The slit is also used (when manufacturing the filiform product from which dispenser 10 is obtained by cutting) to press the powders by means of a cylindrical roll having the same width of the slit, thus forming a recess 14 in the package of powders.

FIG. 2 shows a second embodiment of the dispenser of the invention. In this case a dispenser 20 is formed of a container 21 that is completely closed with the exception of the openings at the edges generated by the cuts through which the dispenser is obtained from the initial manufactured filiform product. This type of dispenser may be manufactured by loading a powder mixture 22 in a metal tube, having larger diameter with respect the filiform final diameter, drawing this assembly in order to obtain the filiform manufactured product and cutting pieces of a desired length from this manufactured product. However, the filiform manufactured product is preferably obtained by starting from a tube filled with the mixture 22 and making it pass through a series of pressing rolls that reduce the cross-section of the manufactured product at each passage and feed it forward among the various sets of rolls. This manufacturing method of dispenser 20 is preferred to the drawing method, because it has been observed that with respect to the drawing method the rolling allows to obtain a linear loading of mercury that is more constant and reproducible, as described in U.S. Pat. No. 6,679,745 B2 in the applicant's name.

Another way of manufacturing a completely closed dispenser structure is by means of a process similar to the one described for the slit type structure, by adjoining the edges of the strip or causing them to overlap. This latter process is particularly useful to produce completely closed mercury dispensers with a polygonal cross-section.

The metal with which the container is made may be any metal stable in air. Preferably, metals easy to work and having low gas emissions upon heating are used in order to prevent undesired gases from entering the lamp in which the dispenser use is envisioned, both as external mercury source via the double pinch off process, or alternatively, in some type of lamps, as internal permanent device. Preferred metals are steel, nickel or nickel-plated iron. The thickness of the metal of the manufactured dispenser is in the order of tenths of a millimeter, typically comprised between about 0.1 and 0.3 mm.

The mixture of powders used in the dispensers of the invention, labelled respectively with 12 and 22 in FIGS. 1 and 2, is formed of a material capable of releasing mercury vapors upon heating and of a metal or an alloy having special mechanical characteristics.

The mercury releasing compound might be an amalgam; however, these compounds are characterized by starting to release the element already at temperatures between about 100 and 200° C., whereby the use of amalgams is possible only for the manufacturing of dispensers to be used in lamps manufacturing processes wherein these temperatures are never reached, with the exception of the dedicated phase in which the dispenser is heated to release mercury. Preferred is the use of compounds of mercury with titanium and/or zirconium, e.g. the compounds having a general formula $Ti_xZr_yHg_z$ described in U.S. Pat. No. 3,657,589 and in particular the compound $Ti_3Hg$ or the compounds described in patent publication WO 2006/008771 A1, in particular the compound having the weight percentage composition of Ti 22.5-Cu 30-Cr 5.5-Hg 42. These compounds are used in the dispensers of the invention in the form of powders having a grain size lower than 250 μm, preferably lower than 125 μm.

The second component of the mixture is a metal or a metal alloy having a hardness lower than 130 HV measured according to the Vickers method. In the rest of the description these metals or alloys will be also defined as plastic components. The Vickers hardness is measured by a standard method in metal technology, which consists in placing a pyramid-shaped diamond tip (having standard shape and size) onto a surface of the material whose hardness must be measured, applying a predefined load to the tip for a predefined time and measuring the size of the mark created by the tip on the surface. The values of the Vickers hardness are indicated with a number followed by the symbol HV. In the most common measuring conditions the load applied to the tip is 30 kg and the load is applied for 10-15 seconds.

These conditions are used for all the tests described in the present specification and it is to be assumed that the Vickers hardness values defining the invention are obtained under these conditions. The inventors have found that powders of metals or alloys having these hardness values have the appropriate characteristics of deforming during the manufacturing treatments of the products from which the dispensers are obtained. In this way the powders of metals or alloys are penetrated by the particles of the mercury compound and act as a "glue" for the particles. Examples of metals suitable for the purposes of the invention are lead, gold, silver, copper, aluminum, zinc, indium, tin, titanium and nickel. Preferably, metals are used that do not generate vapors at temperatures of about 800-900° C. (the temperatures at which the dispensers are heated to cause the emission of mercury) in order to avoid contaminations of the lamp; metals that are not toxic, in order to facilitate the manufacturing operations of the dispensers and their disposal once used, and metals that are of low cost. According to these further choosing criteria, preferred are tin (having a hardness comprised between 30 and 60 HV), aluminum (20-50 HV), copper (50-90 HV), titanium (60-80 HV) and nickel (100, 130 HV). Depending on their composition, the alloys have a considerably variable hardness. Useful alloys for the invention are aluminum-copper alloys, e.g. the alloy containing 25% by weight (or more) of aluminum with a hardness of about 130 HV (or lower); copper-zinc alloys having a hardness comprised between about 60 and 130 HV; or copper-tin alloys containing between about 30 and 80% by weight of tin.

In order to achieve a reduction of the particle loss from the dispensers small percentages of plastic metal or alloys are needed, comprised between 0.5 and 10% on the total weight of the powders mixture. By using weight percentages lower than 0.5%, the amount of the plastic component is too small to obtain the "gluing" effect, whereas amounts greater than 10% lead to a useless reduction of the amount of mercury compound without providing additional advantages. Preferably, the plastic component forms from 2 to 5% by weight of the powder mixture.

In addition to the weight ratio, the retaining effect of the powder is also due to the dimensional ratios of the powders of the materials forming the mixture. Powders of the plastic component having an excessive size could lead to a highly non-homogeneous mixture, with relatively wide zones of the mixture in which the plastic component is not present and therefore does not perform its task. On the other hand the inventors have observed that also excessively fine powders of the plastic component, although ensuring the best homogeneity of the mixture, do not accomplish a reduction of the particle loss from the cut edges of the dispensers. It has been verified that in order to accomplish the objects of the invention the powders of the plastic component must have a size that is not greater than and preferably comprised between 0.2 and 0.8 times the size of the powders of the mercury compound.

The mixture of powders employed in the dispensers of the invention may contain other components in addition to the two above-mentioned components. For instance, the mixture will preferably comprise powders of a getter material for sorbing the gases present in the finished lamps or during their manufacturing steps. As it is widely known in the field, preferred getter materials are metals such as niobium, vanadium and hafnium, and preferably titanium and zirconium, or alloys of zirconium with transition elements, aluminum or rare earths. Preferred getter materials are Zr—Al alloys containing about 16% by weight of aluminum, or Zr—Co-A alloys (where A indicates one or more elements chosen among Y, La or rare earths), which are described in U.S. Pat. No. 5,961,750 in the applicant's name. The size of the getter material particles are similar to the particles of the mercury compound.

When the powder mixture present in the dispenser comprises three (or more) components, the amount of the plastic component by weight must anyway be comprised between 0.5 and 10% (preferably between 2 and 5%) of the total weight of the mixture.

The invention will be further illustrated by the following examples.

EXAMPLE 1

Following the process described in the text, different samples of mercury dispensers are manufactured having the shape shown in FIG. 1 and containing mixtures of powders of a mercury compound having a weight percentage composition Ti 22.5-Cu 30-Cr 5.5-Hg 42 (sold by the applicant under the name St 545), of a getter alloy having the weight percentage composition Zr 84-Al 16 (sold by the applicant under the name St 101) and of aluminum, which is not present in the reference sample. The average size of the powders is respectively lower than 180 μm for the mercury compound and the getter alloy and lower than 125 μm for aluminum. The weight percentages compositions of the mixtures used in the different samples are set forth in table 1.

TABLE 1

| Sample | Weight % St 545 | Weight % Zr—Al alloy | Weight % aluminum |
|---|---|---|---|
| Reference | 50 | 50 | 0 |
| 1 | 49.5 | 49.5 | 1 |
| 2 | 49 | 49 | 2 |
| 3 | 48.5 | 48.5 | 3 |

Regardless of the different compositions of the mixtures, all the samples have been prepared under the same conditions and in particular by applying the same compression load to the cylindrical roll forming the recess in the powders package and by cutting the samples from the initial filiform manufactured product with the same tool and the same applied strength.

Particle loss tests are carried out on these series of samples (300 pieces 8 mm long for each type), by vibrating the samples on a vibrating dish for a time variable between 10 and 40 minutes and measuring the particle loss by weight difference between the beginning and the end of the test. The particle loss tests have been repeated 5 times for each of the samples.

Figure 3:
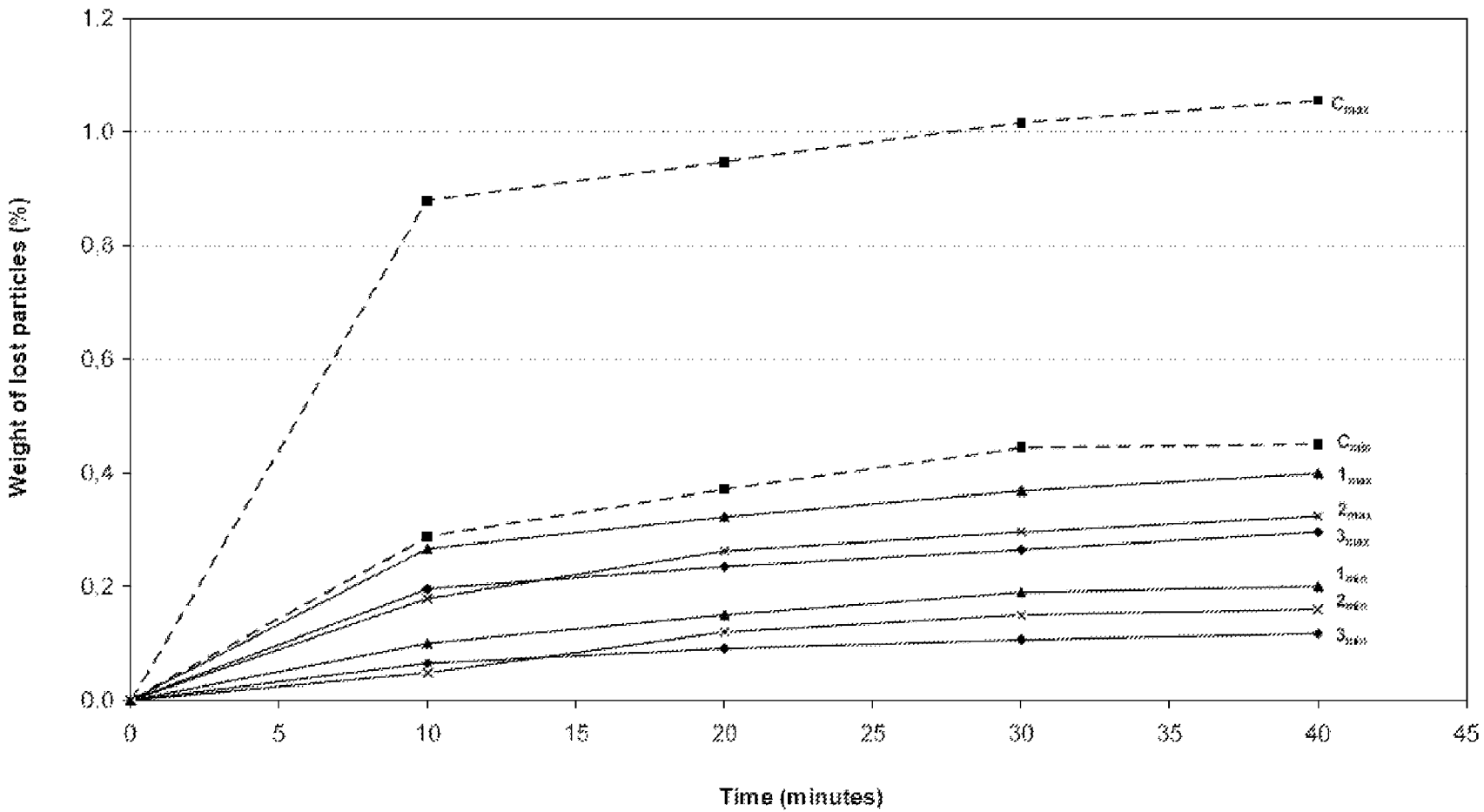
FIG. 3 shows a graph with the results of particle loss tests from dispensers of the invention and dispensers of the prior art.

The results of the tests are illustrated in a graph in FIG. 3. For each series of samples two curves are shown, an upper and a lower one referring to the maximum and minimum values of the particle loss over time for that series of samples (expressed as a weight percentage with respect to the total weight of the powders mixture). Letter "C" indicates the two curves related to the reference sample, whereas numbers 1, 2 and 3 mark the curves related to the series of samples having corresponding numbers in table 1. The curves having a subscript "max" indicate the maximum particle loss values for a given series of samples, whereas the curves having a subscript "min" indicate the minimum particle loss values.

EXAMPLE 2

Similarly to example 1, different samples of mercury dispensers are manufactured having the shape shown in FIG. 1 and containing mixtures of powders of a titanium-mercury compound (sold by the applicant under the name St 505), of a getter alloy having the weight percentage composition Zr 84-Al 16 (sold by the applicant under the name St 101) and of aluminum, which is not present in the reference sample. The weight percentages compositions of the mixtures used in the different samples are set forth in table 2.

TABLE 2

| Sample | Weight % St 505 | Weight % Zr—Al alloy | Weight % aluminum |
|---|---|---|---|
| Reference | 80 | 20 | 0 |
| 1 | 73 | 20 | 7 |

Figure 4:
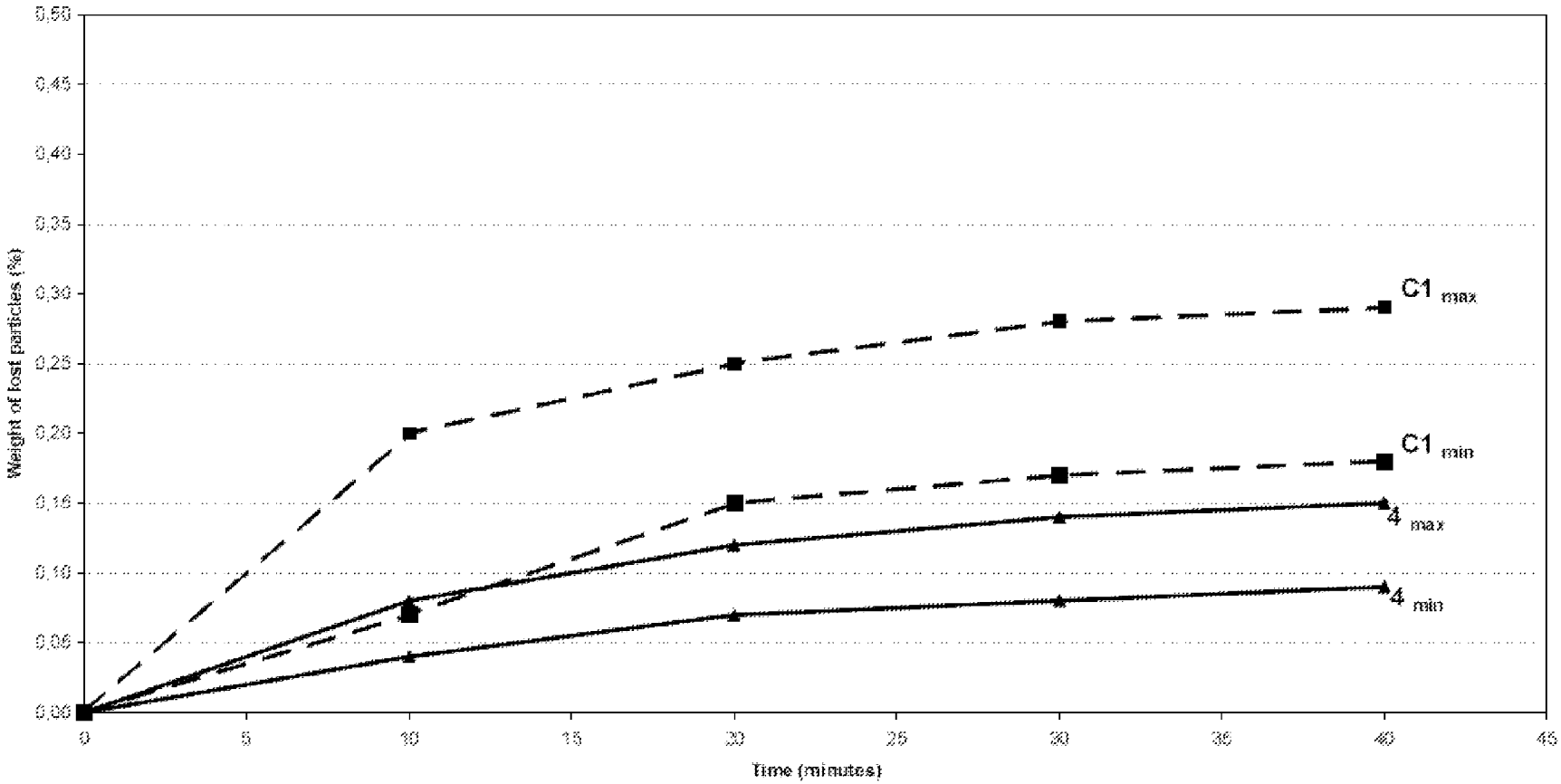
FIG. 4 shows a graph with the results of particle loss tests from dispensers of the invention and dispensers of the prior art with a different dispensing composition and metal loading with respect to the examples shown in FIG. 3.

The results of the tests are illustrated in a graph in FIG. 4. In this case label "C1" indicates the two curves related to the reference sample, whereas reference number 4 designates the curves related to the sample according to the present invention, whose composition is described in table 2; also in this case the curves having a subscript "max" indicate the maximum particle loss values for a given species of samples, whereas the curves having a subscript "min" indicate the minimum particle loss values.

The curves in FIG. 3 and FIG. 4 show that the samples of the invention have a particle loss remarkably lower than the reference samples and also a lower variability in the amount of lost particles. In addition to the reduced particles loss, the feature of the lower variability in the amount of lost particles is useful in the industrial manufacturing of lamps because it allows to have a higher reproducibility of the mercury dosing.

The invention claimed is:

1. A mercury dispensing device having a filiform cross-section, comprising:

a metal container;

a mixture of powders comprised of at least one material suitable for releasing mercury by heating and a metal or a metal alloy, said mixture of powders being arranged inside the metal container;

wherein said metal or metal alloy has a Vickers hardness lower than 130 HV, the weight percentage of said metal or metal alloy is lower than the 10% of the total weight of the mixture of powders and the size of the powders of the metal or metal alloy is comprised between about 0.2 and 0.8 times the size of the powders of the material suitable for releasing mercury.

2. The device according to claim 1, wherein the cross-section is a trapezoidal cross-section with a slit having a width comprised between 200 and 400 μm throughout the length of a face thereof and a recess in the mixture of powders obtained by pressing the powders arranged in correspondence to the slit.

3. The device according to claim 1, wherein the cross-section is a completely closed circular or polygonal cross-section.

4. The device according to claim 1, wherein the metal container is made of a metal selected from steel, nickel and nickel-plated iron.

5. The device according to claim 1, wherein the thickness of the metal of the metal container is comprised between about 0.1 and 0.3 mm.

6. The device according to claim 1, wherein said material suitable for releasing mercury is a compound of mercury with titanium and/or zirconium.

7. The device according to claim 6, wherein said material suitable for releasing mercury is chosen between $Ti_3Hg$ and a compound having a weight percentage composition Ti 22.5-Cu 30-Cr 5.5-Hg 42.

8. The device according to claim 6, wherein powders of the material suitable for releasing mercury have a particle size lower than 250 μm.

9. The device according to claim 8, wherein said particle size is lower than 125 μm.

10. The device according to claim 1, wherein said metal or metal alloy are chosen among: lead, gold, silver, copper, aluminum, zinc, indium, tin, titanium and nickel, aluminum-copper alloys containing at least the 25% by weight of aluminum, copper-zinc alloys and copper-tin alloys containing 30 to 80% by weight of tin.

11. The device according to claim 1, wherein said metal or metal alloy are present in a weight percentage higher than 0.5% of the total weight of the mixture of powders.

12. The device according to claim 1, wherein said weight percentage of said metal or metal alloy is comprised between 2% and 5%.

13. The device according to claim 1, wherein said mixture of powders also comprises powders of a getter material.

14. The device according to claim 13, wherein said getter material is chosen among zirconium, titanium, niobium, vanadium, hafnium and alloys of zirconium with one or a number of elements chosen among transition elements, aluminum or rare earths.

15. The device according to claim 14, wherein said alloys are chosen between a zirconium-aluminum alloy containing about 16% by weight of aluminum and a Zr—Co-A alloy, where A indicates one or more elements chosen among Y, La or rare earths, having an approximate weight percentage composition Zr 80-Co 15-A 5.

16. The device according to claim 13, wherein said powders of getter material have a particle size lower than 250 μm.

17. The device according to claim 13, wherein the metal or metal alloy having a Vickers hardness lower than 130 HV is present in a weight percentage higher than the 0.5% of the total weight of the powders.

18. The device according to claim 17, wherein said weight percentage is comprised between 2% and 5%.

19. A lamp comprising the mercury dispensing device according to claim 1.

20. A method for manufacturing a lamp by way of a double pinch-off process, wherein said process is carried out employing the mercury dispensing device according to claim 1.

21. The method of claim 20, wherein the mercury dispensing device is obtained by cutting a manufactured product having same cross-section of the mercury dispensing device but greater length.

* * * * *